US009616278B2

(12) United States Patent
Olson

(10) Patent No.: US 9,616,278 B2
(45) Date of Patent: Apr. 11, 2017

(54) LATERALLY TILTING TREADMILL DECK

(71) Applicant: ICON Health & Fitness, Inc., Logan, UT (US)

(72) Inventor: Michael L. Olson, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/838,029

(22) Filed: Aug. 27, 2015

(65) Prior Publication Data

US 2016/0059068 A1 Mar. 3, 2016

Related U.S. Application Data

(60) Provisional application No. 62/044,007, filed on Aug. 29, 2014.

(51) Int. Cl.

| | |
|---|---|
| ***A63B 21/005*** | (2006.01) |
| ***A63B 24/00*** | (2006.01) |
| ***A63B 22/02*** | (2006.01) |
| ***A63B 22/00*** | (2006.01) |
| ***A63B 21/00*** | (2006.01) |

(52) U.S. Cl.

CPC .... *A63B 22/0023* (2013.01); *A63B 21/00076* (2013.01); *A63B 22/0235* (2013.01); *A63B 24/0087* (2013.01); *A63B 22/0015* (2013.01); *A63B 22/02* (2013.01)

(58) Field of Classification Search

CPC ..... A63B 21/00076; A63B 22/0023; A63B 22/02; A63B 22/0235; A63B 2022/0271; A63B 24/0087; A63B 2024/009; A63B 22/0015; A63B 22/0257; A63B 22/0264; A63B 2022/002

See application file for complete search history.

(56) References Cited

U.S. PATENT DOCUMENTS

| | | | | |
|---|---|---|---|---|
| 5,205,800 | A | 4/1993 | Grant | |
| 5,562,572 | A * | 10/1996 | Carmein | A61H 3/00 198/779 |
| 6,095,951 | A | 8/2000 | Skowronski et al. | |
| 6,254,515 | B1 | 7/2001 | Carman et al. | |
| 6,719,669 | B1 | 4/2004 | Wang et al. | |

(Continued)

FOREIGN PATENT DOCUMENTS

| | | |
|---|---|---|
| JP | 2009-189714 | 8/2009 |
| JP | 2013-102813 | 5/2013 |
| KR | 10-2012-0132268 | 12/2012 |

OTHER PUBLICATIONS

International Search Report issued in PCT/US2015/047270 on Oct. 23, 2015.

(Continued)

*Primary Examiner* — Joshua Lee
(74) *Attorney, Agent, or Firm* — Holland & Hart LLP

(57) ABSTRACT

A treadmill includes a running deck. The running deck includes a front portion, a rear portion connected to the front portion by a first side and a second side, a tread belt surrounding the front portion and the rear portion, a motor to drive movement of the tread belt, and an actuator that cause the running deck to tilt laterally towards either the first side or the second side to form a lateral tilt angle in response to a tilt command.

18 Claims, 9 Drawing Sheets

(56) References Cited

U.S. PATENT DOCUMENTS

| | | | | |
|---|---|---|---|---|
| 6,945,912 | B2 | 9/2005 | Levi | |
| 7,682,291 | B2 * | 3/2010 | Gill | A63B 22/02 482/51 |
| 8,315,823 | B2 * | 11/2012 | Berme | G01L 25/00 702/101 |
| 8,790,222 | B2 * | 7/2014 | Burger | A63B 21/0087 482/51 |
| 2009/0209393 | A1 | 8/2009 | Crater et al. | |
| 2010/0304931 | A1 * | 12/2010 | Stumpf | A63B 22/02 482/4 |
| 2012/0220427 | A1 | 8/2012 | Ashby et al. | |
| 2012/0302408 | A1 * | 11/2012 | Burger | A63B 21/0087 482/54 |
| 2013/0274069 | A1 * | 10/2013 | Watterson | A63B 24/0087 482/9 |
| 2014/0113770 | A1 | 4/2014 | Yim | |
| 2014/0221167 | A1 | 8/2014 | Wu | |
| 2015/0335941 | A1 * | 11/2015 | Lo | A63B 22/0015 482/54 |

OTHER PUBLICATIONS

English translation of the abstract of JP 2013-102813. May 30, 2013.
English translation of the abstract of KR 10-2012-0132268. Dec. 5, 2012.
English translation of the abstract of JP 2009-189714. Aug. 27, 2009.

* cited by examiner

LATERALLY TILTING TREADMILL DECK

RELATED APPLICATIONS

This application claims priority to U.S. patent application Ser. No. 62/044,007 titled "Laterally Tilting Treadmill Deck" and filed on 29 Aug. 2014, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include ellipticals, rowing machines, stepper machines, and stationary bikes to name a few.

One type of treadmill is disclosed in U.S. Patent Publication No. 2012/0220427 issued to Darren C. Ashby, et al. In this reference, an exercise system includes one or more exercise devices that communicate via a network with a communication system. The communication system stores and/or generates exercise programming for use on the exercise device. The exercise programming is able to control one or more operating parameters of the exercise device to simulate terrain found at a remote, real world location. The exercise programming can include images/videos of the remote, real world location. The control signals and the images/videos can be synchronized so that a user of the exercise device is able to experience, via the changing operating parameters, the topographical characteristics of the remote, real world location as well as see images of the location. Another type of treadmill is described in U.S. Patent Publication No. 2009/0209393 issued to Bradley A. Crater, et al.

SUMMARY

In one embodiment, a treadmill includes a running deck. The running deck includes a front portion, a rear portion connected to the front portion by a first side and a second side, a tread belt surrounding the front portion and the rear portion, a motor to drive movement of the tread belt, and a chassis that supports the running deck. The chassis includes a central axle along a length of the running deck and a base that support the chassis where the actuator is connected to both the chassis and the base. At least one actuator causes the running deck to incline longitudinally in response to an incline command and to simultaneously tilt laterally by rotating the chassis about the central axle towards either the first side or the second side to form a lateral tilt angle in response to a tilt command.

The actuator may be positioned to adjust a first elevation of the first side of the running deck.

The actuator may be positioned to adjust a second elevation of the second side of the running deck.

The running deck may elevate the front portion to position the running deck at a positive lengthwise slope in response to a slope command.

The running deck may elevate the rear portion to position the running deck at a negative lengthwise slope in response to a slope command.

The actuator may create the lateral tilt angle while the motor drives the tread belt in response to the tilt command.

The treadmill may include a processor and memory. The memory may include programmed instructions executable by the processor to elevate the first side or the second side to create the lateral tilt angle by sending the tilt command.

The instructions may be executable by the processor to simulate a real world route on the treadmill.

The instructions may be executable by the processor to create the lateral tilt angle while simulating the real world route.

The instructions may be executable by the processor to create the lateral tilt angle while elevating the front portion of the running deck.

The instructions may be executable by the processor to create the lateral tilt angle while elevating the rear portion of the running deck.

In one embodiment, a treadmill includes a running deck. The running deck includes a front portion, a rear portion connected to the front portion by a first side and a second side, a tread belt surrounding the front portion and the rear portion, a motor to drive movement of the tread belt, and an actuator that cause the running deck to tilt laterally towards either the first side or the second side to form a lateral tilt angle in response to a tilt command. The treadmill further includes a chassis that supports the running deck and a base that support the chassis. The actuator is connected to both the chassis and the base causes the running deck to pivot to create the lateral tilt angle.

The actuator may create the lateral tilt angle while the motor drives the tread belt.

The treadmill may include a processor and memory. The memory may include instructions executable by the processor to elevate the first side or the second side to create the lateral tilt angle.

The instructions may be executable by the processor to simulate a real world route on the treadmill.

The instructions may be executable by the processor to create the lateral tilt angle while elevating the front portion of the running deck.

The instructions may be executable by the processor to create the lateral tilt angle or while changing an elevation of the rear portion of the running deck.

The chassis may include a central axle being connected to the chassis.

The actuator may create the lateral tilt angle by rotating the chassis about the central axle.

In one embodiment, a treadmill includes a running deck. The running deck includes a front portion, a rear portion connected to the front portion by a first side and a second side, a tread belt surrounding the front portion and the rear portion, a motor to drive movement of the tread belt, an actuator that cause the running deck to tilt laterally towards either the first side or the second side to form a lateral tilt angle in response to a tilt command. The treadmill also includes a chassis that supports the running deck, a central axle being connected to chassis, and a base that support the chassis. The actuator is connected to both the chassis and the base causes the running deck to pivot to create the lateral tilt angle by rotating the chassis about the central axle. The treadmill also includes a processor and memory. The memory includes instructions executable by the processor to elevate the first side or the second side to create the lateral tilt angle, simulate a real world route on the treadmill, and create the lateral tilt angle while elevating the front portion of the running deck or while elevating the rear portion of the running deck.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The principles described herein include a treadmill that has the ability to mimic real world terrain. One type of feature that allows the treadmill to mimic the real world terrain includes an ability to incline the treadmill's running deck, decline the treadmill's running deck, and laterally tilt the running deck on either side.

Figure 1A:
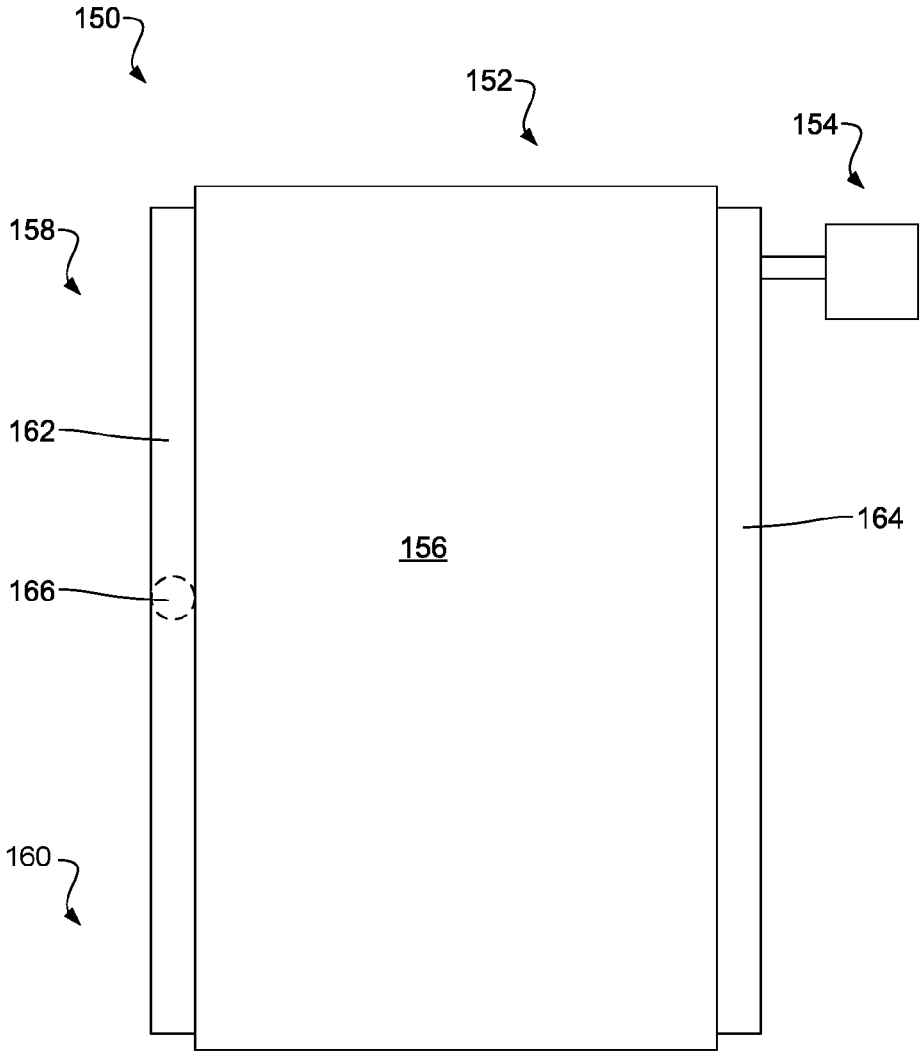
FIG. 1A illustrates a view of an example of a treadmill in accordance with the present disclosure.

Particularly, with reference to the figures, FIG. 1A depicts a treadmill 150 that includes a running deck 152. The running deck includes a front portion 158, a rear portion 160 connected to the front portion 158 by a first side 162 and a second side 164, a tread belt 156 surrounding the front portion 158 and the rear portion 160, a motor 154 arranged to drive movement of the tread belt 156, and an actuator 166 that cause the running deck to tilt laterally towards either the first side or the second side to form a lateral tilt angle in response to a tilt command.

FIGS. 1B-6 depict a treadmill 100. The treadmill 100 includes a running deck 102 that can support the weight of a user and that is attached to a frame 104. The running deck 102 incorporates a tread belt 106 that extends from a first pulley at a first location 108 to a second pulley at a second location 110. The underside of the tread belt's mid-section is supported by a low friction surface that allows the tread belt's underside to move along the mid-section's length without creating significant drag. The tread belt 106 is moved by a motor that is connected to the first pulley and is disposed within a housing 112 in a front portion 114 of the running deck 102. As the tread belt 106 moves, a user positioned on the tread belt 106 can walk or run in place by keeping up with the tread belt's speed.

Figure 1B:
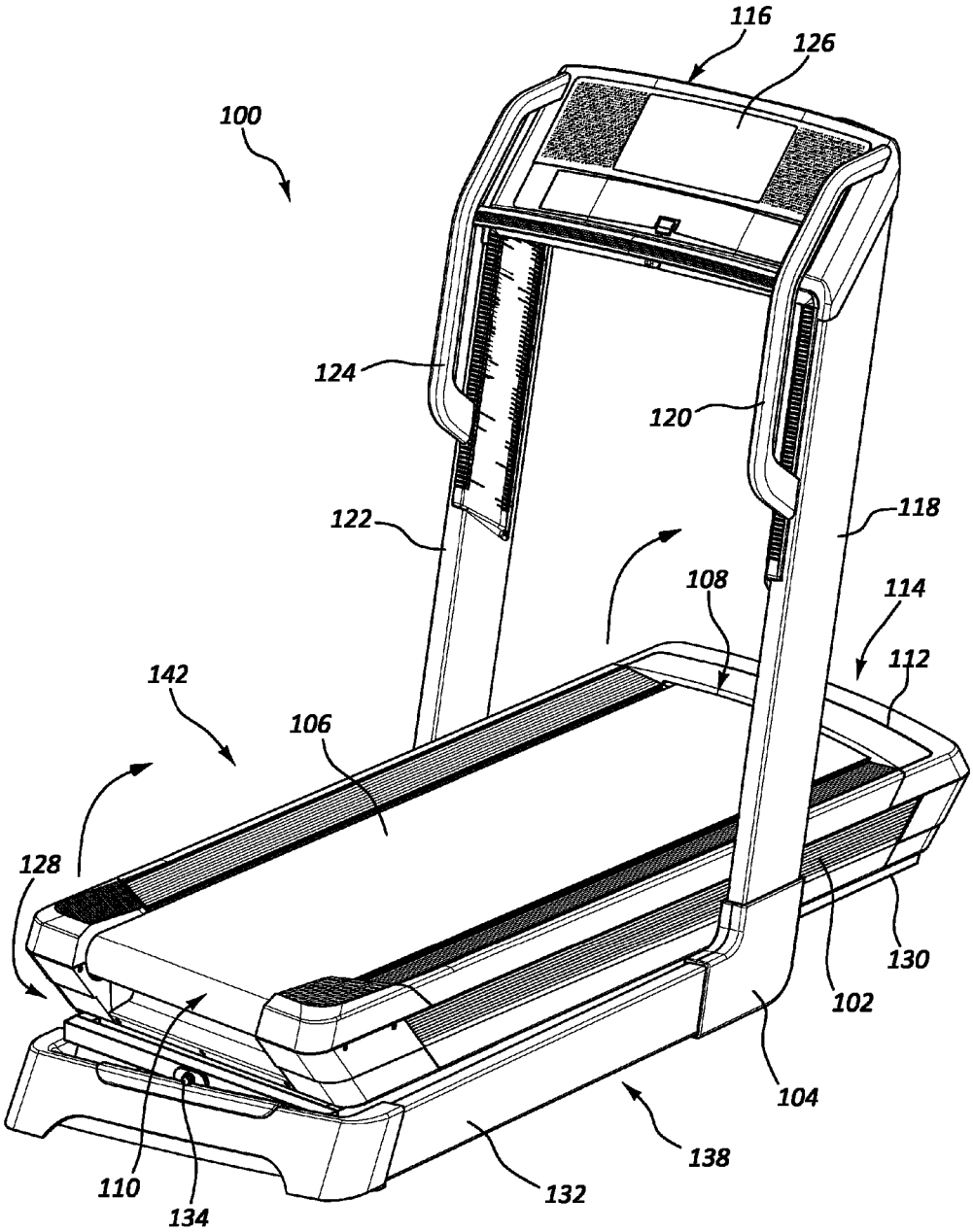
FIG. 1B illustrates a perspective view of an example of a treadmill in accordance with the present disclosure.
Figure 2:
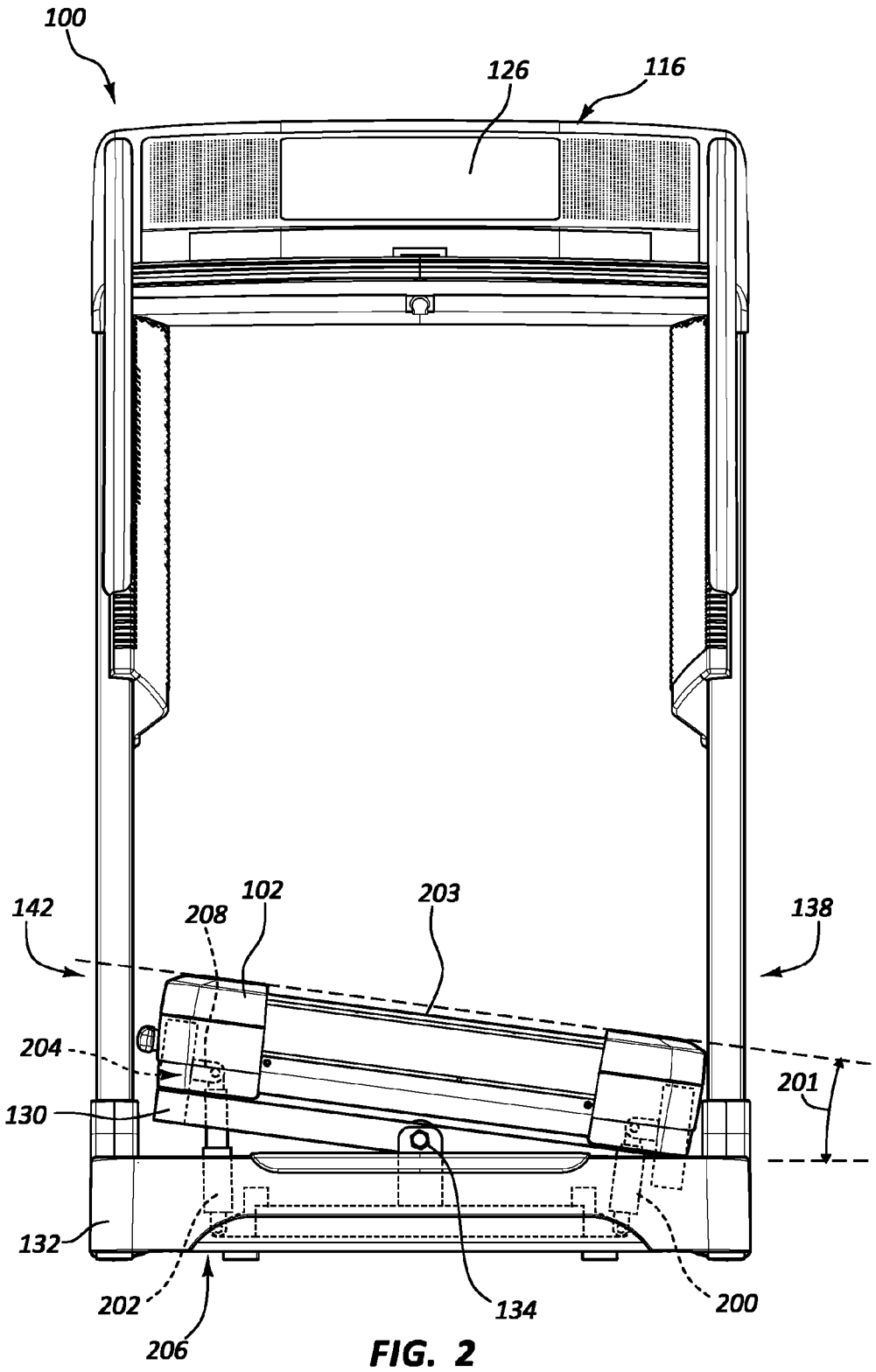
FIG. 2 illustrates a rear view of the treadmill depicted in FIG. 1B with a running deck laterally tilted to a first side.
Figure 3:
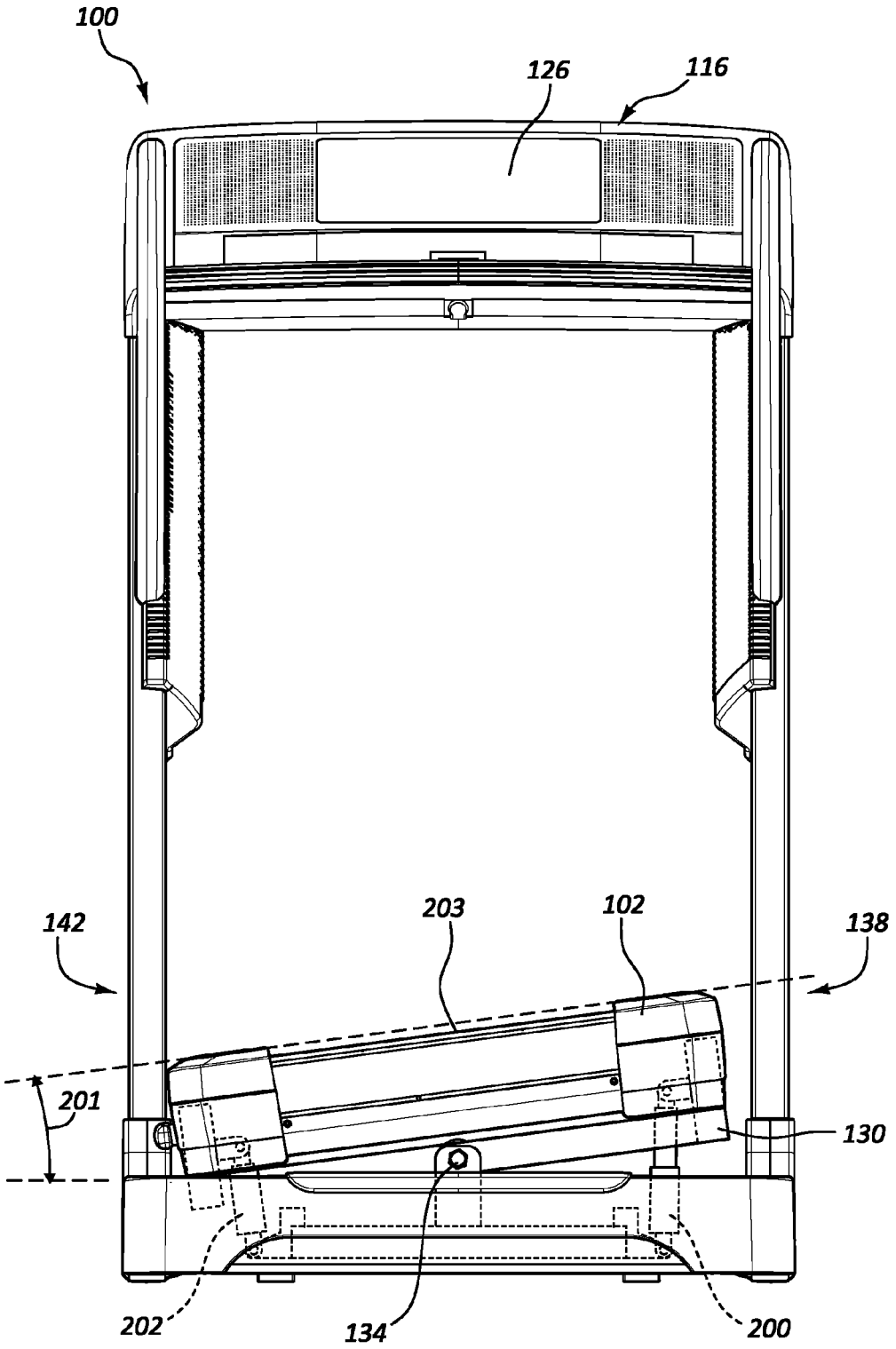
FIG. 3 illustrates a rear view of the treadmill depicted in FIG. 1B with a running deck laterally tilted to a second side.
Figure 4:
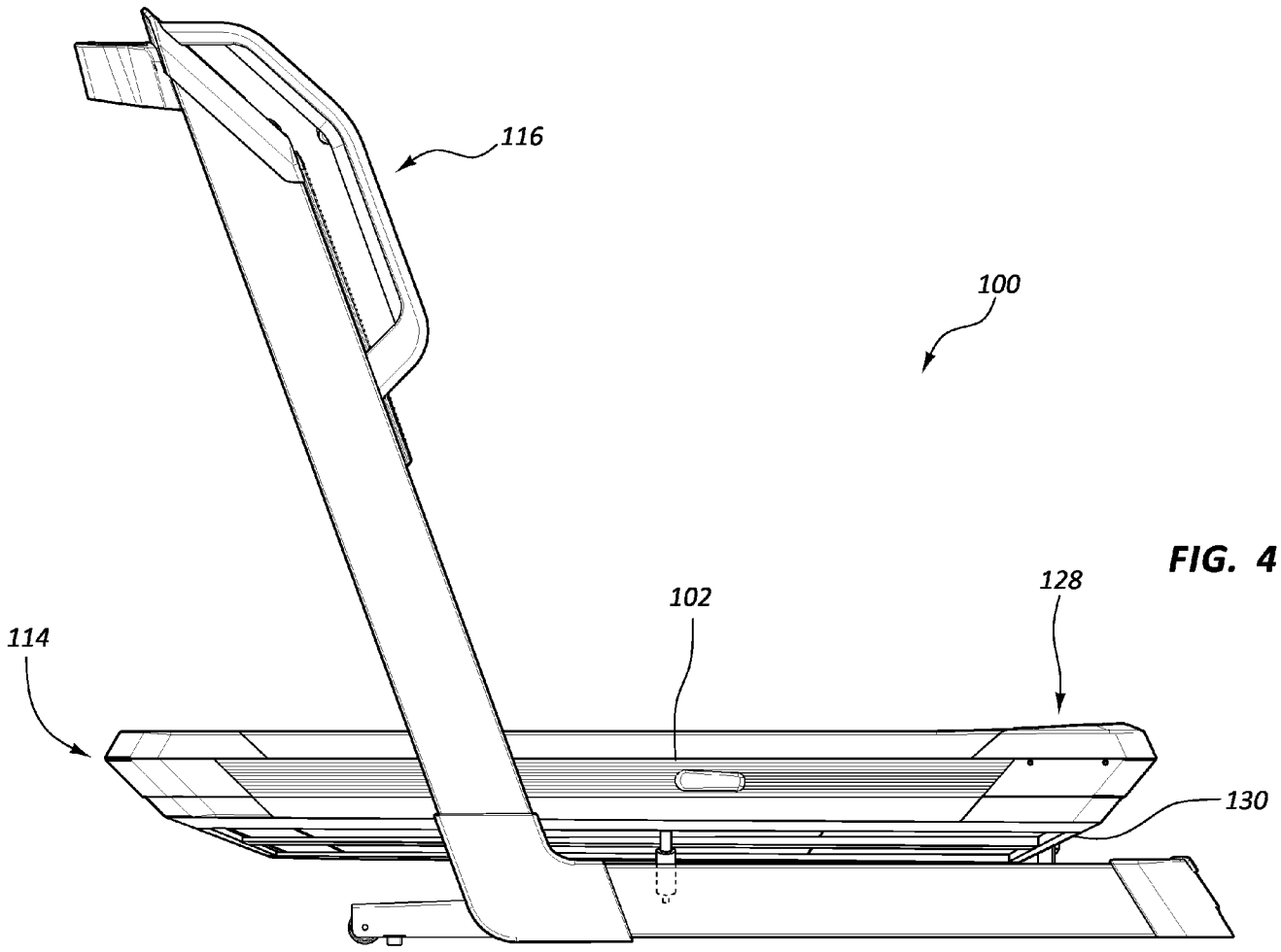
FIG. 4 illustrates a side view of the treadmill depicted in FIG. 1B with a running deck laterally tilted to a first side.
Figure 5:
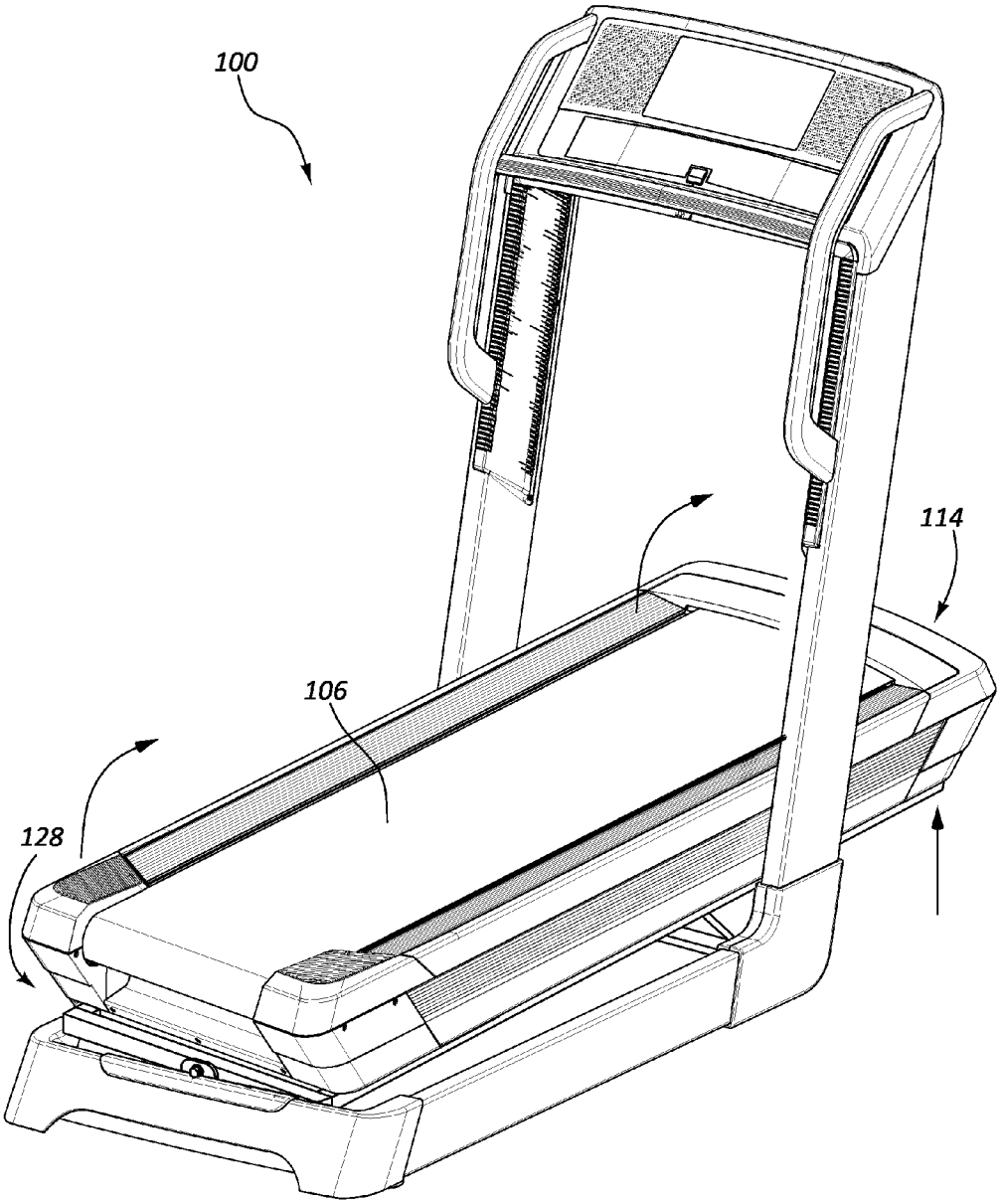
FIG. 5 illustrates a rear view of the treadmill depicted in FIG. 1B with a running deck laterally tilted to a side and a front portion of the running deck being elevated.
Figure 6:
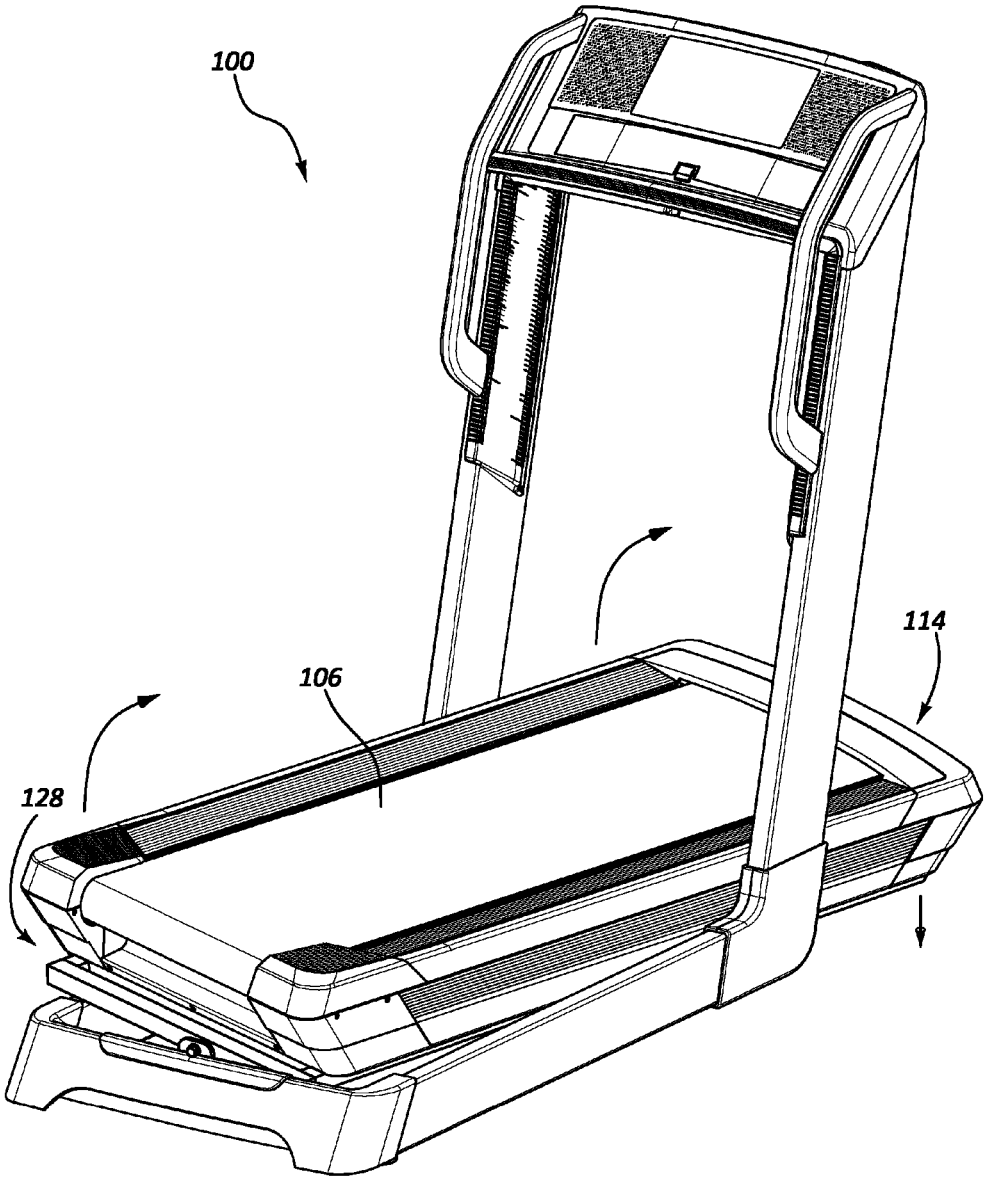
FIG. 6 illustrates a rear view of the treadmill depicted in FIG. 1B with a running deck laterally tilted to a side and a rear portion of the running deck being elevated.

A control console 116 is also supported by the frame 104. In the example of FIG. 1B, a first frame post 118 positions a first hand hold 120 near the control console 116, and a second frame post 122 positions a second hand hold 124 near the control console 116 so that a user can support himself or herself during exercise. The control console 116 allows the user to perform a predetermined task while simultaneously operating an exercise mechanism of the treadmill 100 such as control parameters of the running deck 102. For example, the control console may include controls to adjust the speed of the tread belt 106, adjust a volume of a speaker integrated into the treadmill 100, adjust an incline angle of the running deck 102, adjust a decline of the running deck 102, adjust a lateral tilt of the running deck 102, select an exercise setting, control a timer, change a view on a display 126 of the control console 116, monitor the user's heart rate or other physiological parameters during the workout, perform other tasks, or combinations thereof. Buttons, levers, touch screens, voice commands, or other mechanisms may be incorporated into the control console 116 incorporated into the treadmill 100 and can be used to control the capabilities mentioned above. Information relating to these functions may be presented to the user through the display 126. For example, a calorie count, a timer, a distance, a selected program, an incline angle, a decline angle, a lateral tilt angle, another type of information, or combinations thereof may be presented to the user through the display 126.

The treadmill 100 may include preprogrammed workouts that simulate an outdoor route. In other examples, the treadmill has the capability of depicting a real world route. For example, the user may input instructions through the control console 116, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display 126 of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display 126 to account for changes to the route's location, such as real time weather, recent construction, and so forth. Further, the display 126 may also add simulated features to the display, such as simulated vehicular traffic, simulated flora, simulated fauna, simulated spectators, simulated competitors, or other types of simulated features. While the various types of routes have been described as being presented through the display 126 of the control console 116, the route may be presented through another type of display, such as a home entertainment system, a nearby television, a mobile device, another type of display, or combinations thereof.

In addition to simulating the route through a visual presentation of a display, the treadmill may also modify the orientation of the running deck 102 to match the inclines and slopes of the route. For example, if the beginning of the simulated route is on an uphill slope, the running deck 102 may be caused to alter its orientation to raise the front portion 114 of the running deck 102. Likewise, if the beginning of the simulate route is on a downward slope, the rear portion 128 of the running deck 102 may be caused to elevate to simulate the decline in the route. Also, if the route has a lateral tilt angle, the running deck 102 may be tilted laterally to the appropriate side of the running deck 102 to mimic the lateral tilt angle.

As the user begins to walk or run on the running deck, the display may change the scenery to mimic what the user would see if the user were actually at the real world location of the selected route. For example, a tree or another object located along the route that appears to be in the distance when the user is simulated to be at the beginning of the route may appear progressively closer as the user walks or runs on the running deck 102 based on the speed at which the user is simulated to be traveling. Additionally, as the inclines and slopes of the simulated route change as the user progresses along the simulated route, the running deck can adjust to account for these terrain changes. For example, if the steepness of an uphill incline increases in the route, the running deck can likewise increase the incline of the running deck to mimic the change in steepness. Further, if the lateral angle of the route changes, the running deck can tilt laterally to one side to mimic the route's lateral angle.

The running deck 102 may be laterally tilted with any appropriate tilting mechanism. In the illustrated figures, the running deck 102 is supported on a chassis 130 that is pivotally connected to a base 132 along a central axle 134 of the chassis 130. A first linear actuator 200 is connected to a first side 138 of the chassis 130, and a second linear actuator 202 is connected to a second side 142 of the chassis 130. As the first linear actuator 200 extends, the first side 138 of the running deck 102 rises causing the lateral tilt angle 201 to change. Likewise, as the second linear actuator 202 extends, the second side 142 of the running deck 102 rises causing the lateral tilt angle 201 to change. Retracting either the first or second linear actuators 200, 202 also causes the lateral tilt angle 201 to change. In some examples, either the first or the second linear actuator 200, 202 extends while other linear actuator is simultaneously retracted to create the desired lateral tilt angle 201. In other examples, the linear actuators 200, 202 are controlled to adjust the elevation of just one side of the running deck 102 at a time.

Any appropriate type of linear actuator may be used in accordance with the principles described herein. For example, a non-exhaustive list of linear actuators that may be used as the first or second linear actuator includes screw actuators, hydraulic actuators, pneumatic actuators, solenoids, magnetic actuators, cams, electro-mechanical actuators, telescoping actuators, other types of linear actuators, or combinations thereof. Further, the linear actuators 200, 202 may be powered with a motor, compressed gas, electricity, magnetic fields, other types power sources, or combinations thereof. Further, the linear actuators 200, 202 may also have the ability to laterally tilt the running deck 102 to any appropriate angle formed between a running surface 203 of the running deck 102 and the surface upon which the treadmill 100 rests. For example, the range of the lateral tilt angle may span from negative 55 degrees to positive 55 degrees measured from either the first side or the second side 138, 142 or any range there between.

In some examples, a chassis end 204 of the linear actuators 200, 202 is connected to the chassis 130, and a base end 206 of the linear actuators 200, 202 is connected to the base 132. Each actuator connection may include a pivot 208 so that the orientation of the linear actuators 200, 202 may move as the running deck changes orientations. But, any appropriate type of actuator connection to the base and/or the running deck 102, may be used in accordance with the principles described herein. Further, while the example illustrated in FIGS. 1B-6 depict a single linear actuator on each of the first side 138 and second side 142, any appropriate number of linear actuators on each side may be used to cause the running deck 102 to tilt. For example, multiple linear actuators may be evenly distributed along the length of either or both of the first side 138 and second side 142 to support the weight of the running deck 102. In others examples, an additional linear actuator is positioned at a location along the length of either or both of the first and second side 138, 142 to correspond where the user's weight is likely to be loaded to the running deck 102. In some examples, the linear actuators may be attached to tracks of the chassis 130 and of the base 132 so that the linear actuators can slide along the lengths of the first and/or second sides 138, 142 to appropriate position the linear actuators at those locations along the first and second sides 138, 142 based on where the user's weight is actually being loaded to the running deck 102. Further, the treadmill 100 may incorporate at least one stand upon which the running deck 102 can rest. In this example, the linear actuators can lift the appropriate side of the running deck 102 to the appropriate height, and the stands can help hold the weight of the running deck 102 in place while the lateral tilt angle 201 is being maintained.

The chassis 130 may include any appropriate type of structure shape. For example, the chassis 130 may form a rectangular perimeter on which the running deck 102 can be secured. In some examples, a central axle 134 may bifurcate or otherwise divide the rectangular perimeter. In this example, the central axle 134 may be pivotally connected to the base 132 so that when either the first or the second linear actuator 200, 202 changes their height to change the lateral tilt angle 201 of the running deck 102 that the chassis 130, and therefore the running deck 102, pivot about the central axle 134. In other examples, the chassis 130 has a front beam and a rear beam that are pivotally attached to the base 132. The structure of the chassis 130 may also include a solid structure, multiple trusses, other types of supports, other types of structures, or combinations thereof.

In the illustrated example, the base 132 is part of the treadmill's frame 104 and is integrally connected to the frame posts 118, 122 that support the control console 116. But, in other examples, the base 132 may be independent of the treadmill's frame 104.

The running deck 102 may also have the capability of adjusting the height of both its front portion 114 and rear portion 128. For example, a motor may be positioned in the front portion 114 of the running deck 102 that can adjust the height of the front portion 114 to cause the running deck 102 to be sloped at an incline. Further, another motor may be positioned at the rear portion 128 to adjust the height of the rear portion 128 to cause the running deck 102 to be sloped at a decline. While this example has been described with reference to independent mechanisms for independently lowering and raising the front portion 114 and the rear portion 128, these height adjustments may be executed with a single mechanism. For example, a height adjustment mechanism positioned in the front portion 114 of the running deck 102 may include a height adjustment range sufficient to lower the front portion 114 so that the running deck is brought into a declining orientation. Continuing with the same example, the same height adjustment mechanism may also raise the front portion 114 high enough to orient the running deck 102 in an incline.

Regardless of the type of inclining and/or declining mechanisms incorporated into treadmill 100, these height adjustment mechanisms may incline or decline the running deck at any appropriate slope. For example, the range of the running deck's lengthwise slope may range from negative 60 degree to positive 60 degrees or any range there between.

While the above described examples have been described with reference to a treadmill 100 with a running deck that can change its lengthwise slope and lateral tilt angle in response to instructions from a workout program simulating a route, the lengthwise slope and lateral tilt angle may be adjusted in response to any appropriate source of instructions. For example, the control console 116 may include input mechanisms for the user to instruct the treadmill to change the lengthwise slope or the lateral tilt angle at the user's request independent of a simulation program.

Figure 7:
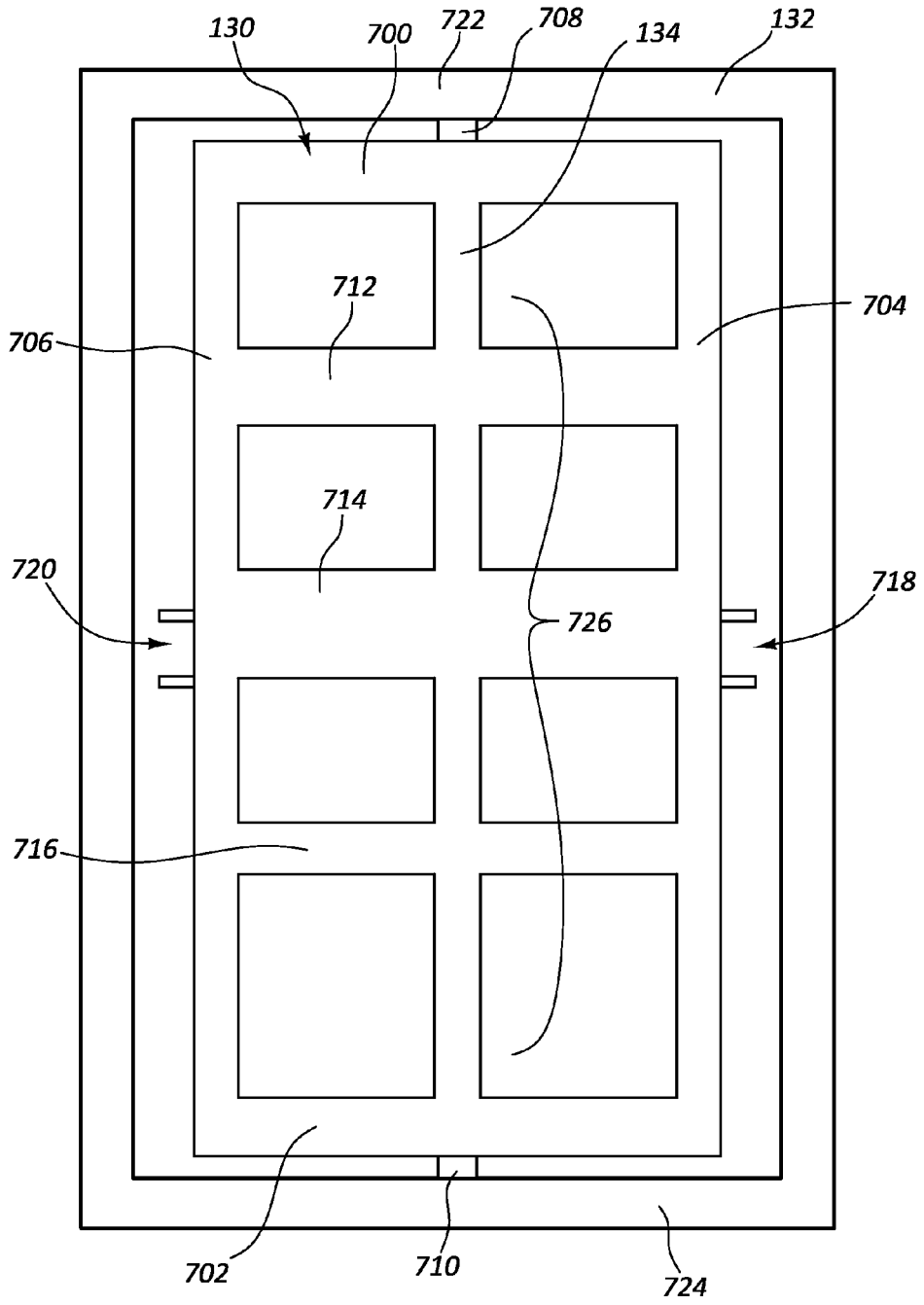
FIG. 7 illustrates a top view of an example of a chassis and base in accordance with the present disclosure.

FIG. 7 illustrates a top view of an example of a chassis 130 and base 132 in accordance with the present disclosure. In this example, the chassis 130 forms a rectangular perimeter with a front beam 700, a rear beam 702, a first side beam 704, and a second side beam 706. The central axle 134 runs through the middle of the chassis 130 intersecting the front beam 700 and the rear beam 702. Further, a front end 708 of the central axle 134 extends beyond the front beam 700, and a rear end 710 of the central axle 134 extends beyond the rear beam 702. The front end 708 and the rear end 710 are connected to the base 132. The connection may allow for rotational movement between the central axle 134 and the base 132. As a result, the chassis 130 can rotate or pivot about the central axle 134 as the linear actuators 200, 220 move the first and second sides 138, 142 of the chassis 130 up and down. An example of a rotary connection between the base 132 and the central axle 134 may include that the front end 708 and the rear end 710 are inserted into openings formed in the base 132. These openings may include an appropriate width and an appropriate shape to allow the central axle 134 to rotate. But, any appropriate type of rotary or pivot connection between the central axle 134 and the base 132 may be used in accordance with the principles described in the present disclosure.

Additionally, cross bars 712, 714, 716 connect the first and second side beams 704, 706 to the central axle 134 to distribute the forces from the weight of the running deck 102 and the movement of the linear actuators 200, 202 throughout the chassis. A first pair 718 of connection plates are attached to the first side beam 704, and a second pair 720 of connection plates are attached to the second side beam 706. These pairs 718, 720 of connection plates are shaped to receive a pivot rod (not shown) which can connect with both plates of the pair. The chassis end 204 of the linear actuators 200, 202 can also attach to the pivot rods. Thus, the pivot rods can link the chassis 130 and the linear actuators 200, 202 together.

In the example of FIG. 7, the base 132 has a front section 722 that connects to the front end 708 of the central axle 134 and a rear section 724 that connects to the rear end of the central axle 134. The base 132 may connect to the chassis 130 or to central axle in any appropriate manner. For example, the base 132 may connect to a mid-section 726 of the central axle 134. In this example, the chassis 130 may include a longer length than the base 132. In yet other examples, the base 132 may include multiple independent components that collectively support the chassis 130 in this manner that the chassis 130 can incline, decline, and laterally tilt to appropriate position the running deck 102 as desired.

In some examples, a linear actuator is attached to the front section 722 of the base 132. This linear actuator may move the base 132 to create an incline. Likewise, a linear actuator is attached to the rear section 724 of the base 132. This linear actuator may move the base 132 to create a decline. In some examples, just a portion of the front section 722 or the rear section 724 of the base 132 is movable to be elevated to incline and/or decline the chassis 130 and therefore the running deck 102.

Figure 8:
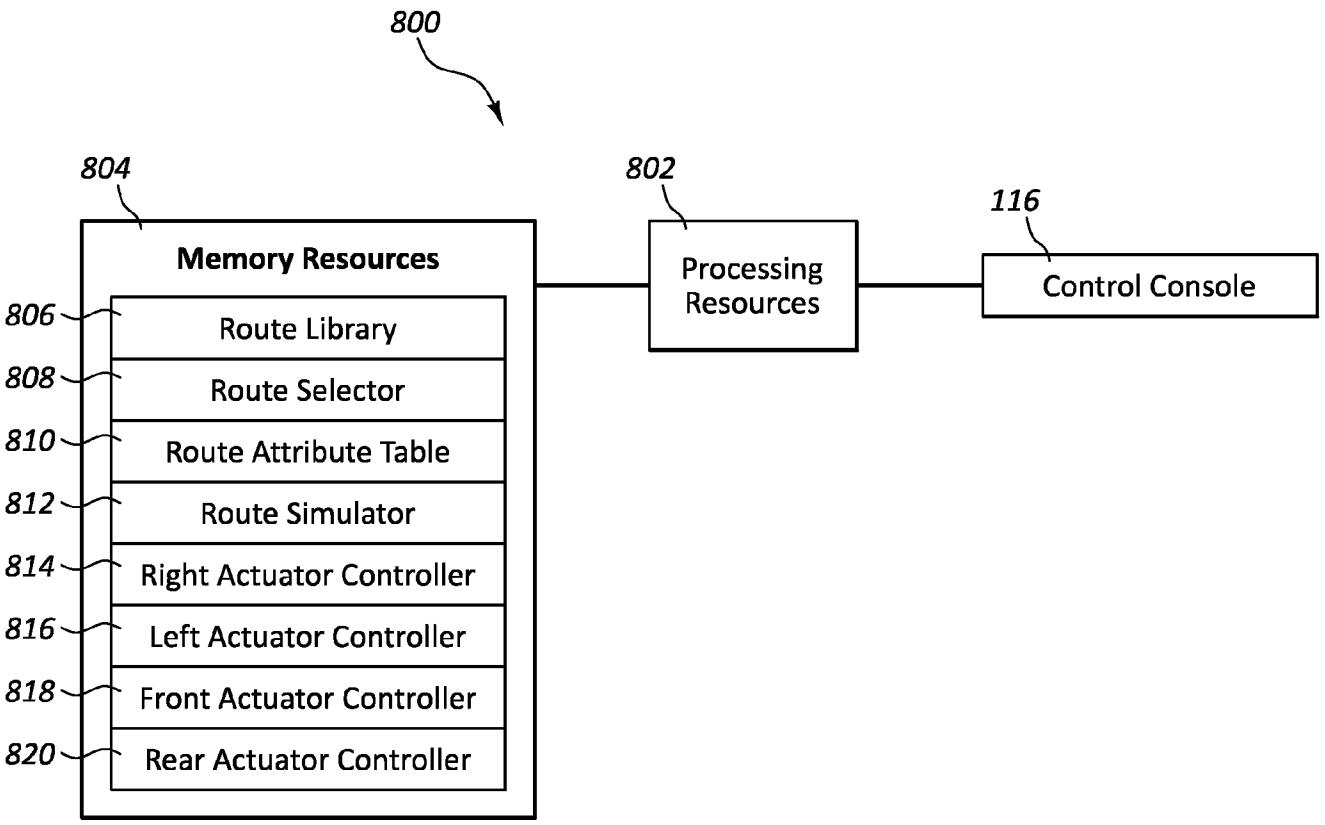
FIG. 8 is a block diagram of an example of an elevation control system incorporated into a running deck in accordance with the present disclosure.

FIG. 8 illustrates a block diagram of an example of an elevation control system 800 in accordance with the present disclosure. The elevation control system 800 may include a combination of hardware and program instructions for executing the functions of the elevation control system 800. In this example, the elevation control system 800 includes processing resources 802 that are in communication with memory resources 804. Processing resources 802 include at least one processor and other resources used to process programmed instructions. The memory resources 804 represent generally any memory capable of storing data such as programmed instructions or data structures used by the elevation control system 800. The programmed instructions shown stored in the memory resources 804 include a route selector 808, a route simulator 812, a right actuator controller 814, a left actuator controller 816, a front actuator controller 818, and a rear actuator controller 820. Further, the data structures stored in the memory resources 804 include a route library 806 and a route attribute table 810.

The memory resources 804 include a computer readable storage medium that contains computer readable program code to cause tasks to be executed by the processing resources 802. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The route selector 808 represents programmed instructions that, when executed, cause the processing resources 802 to select a route based on user input. In some examples, the route is selected from a route library 806. But, in other examples, the route is constructed based on the user's instructions. In this example, the constructed route may be added to the route library 806. The route simulator 812 represents programmed instructions that, when executed, cause the processing resources 802 to simulate the selected route. When the route is constructed, meta data representing attributes of the route may be generated and stored in the route attribute table 810. The route simulator 812 may draw upon the route attribute table 810 to determine characteristics of the selected route. These attributes may include the appropriate inclines, declines, and lateral tilts that are associated with each portion of the route. Additionally, the route simulator may send instructions to the actuator controllers to change the orientation of the running deck to mimic the terrain's slope and tilt angle.

The right actuator controller 814 represents programmed instructions that, when executed, cause the processing resources 802 to control the height of the running deck 102 supported by the right linear actuator, and thereby modify the lateral tilt angle of the running deck 102. The left actuator controller 816 represents programmed instructions that, when executed, cause the processing resources 802 to control the height of the running deck 102 supported by the left linear actuator, and thereby modify the lateral tilt angle of the running deck 102. The front actuator controller 818 represents programmed instructions that, when executed, cause the processing resources 802 to control the height of the running deck 102 supported by a front actuator, and thereby modify the lengthwise slope of the running deck 102. The rear actuator controller 820 represents programmed instructions that, when executed, cause the processing resources 802 to control the height of the running deck 102 supported by a rear actuator, and thereby modify the lengthwise slope of the running deck 102.

Further, the memory resources 804 may be part of an installation package. In response to installing the installation package, the programmed instructions of the memory resources 804 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources 804 can include integrated memory such as a hard drive, a solid state hard drive, or the like.

In some examples, the processing resources 802 and the memory resources 804 are located within the treadmill 100. The memory resources 804 may be part of the treadmill's main memory, caches, registers, non-volatile memory, or elsewhere in the treadmill's memory hierarchy. Alternatively, the memory resources 804 may be in communication with the processing resources 802 over a network. Further, the data structures, such as the libraries, may be accessed from a remote location over a network connection while the programmed instructions are located locally. Thus, the elevation control system 800 may be implemented on the treadmill 100, a mobile device, the fitness tracking device, a remote route simulation device, an electronic tablet, a wearable computing device, a head mounted device, a server, a collection of servers, a networked device, a watch, or combinations thereof. This implementation may occur through input mechanisms, such as push buttons, touch screen buttons, voice commands, dials, levers, other types of input mechanisms, or combinations thereof.

The elevation control system 800 of FIG. 8 may be part of a general purpose computer. But, in alternative examples, the elevation control system 800 is part of an application specific integrated circuit.

While the examples above have been described with reference to changing the lateral tilt angle with linear actuators, any appropriate type of actuator may be used in accordance with the principles described herein. For example, other types of actuators, other than linear actuators, may be used in accordance with the principles described in the present disclosure.

INDUSTRIAL APPLICABILITY

In general, the invention disclosed herein may provide users with a treadmill that can adjust the lateral tilt angle of the treadmill's running deck. Further, the running deck may be capable of having its front portion raised and lowered as well as its rear portion raised and lowered to control the lengthwise slope of the running deck. With these elevation controls, the orientation of the running deck can be adjusted as desired by the user. In those examples where the treadmill is involved with simulating a route that involves changes in elevation, the running deck can be oriented to mimic the elevation changes in the route.

The lateral tilt angle of the running deck can be controlled with one or more actuators, often linear actuators, positioned on both sides of the running deck. These actuators can be connected to a chassis supporting the weight of the running deck and a stationary base. Thus, in response to determining that the running deck's orientation should change, a signal can be sent to the actuators to appropriately move to achieve the desired orientation.

The running deck may be strong enough to support the running deck and also provide locations to attach the actuators. But, in other situations, the actuators may be attached directly to the running deck at locations that are sufficiently strong to carry the load of both the running deck as well as the weight of the user. The chassis also provide a central pivot about which the running deck can rotate as the actuators change their heights and/or lengths. As a result, the running deck can smoothly changes its lateral tilt. A smooth transition from one lateral tilt angle to anther provides the user with a more natural feel as the user runs along the simulated route. Further, the principles described in the present disclosure can work simultaneously with the operation of the motor that drives the tread belt. Thus, the user does not have to dismount from the treadmill so that the lateral tilt angle can be changed. Also, the principles described herein can also allow the lateral tilt angle to be changed while the front portion of the running deck is being elevated or lowered as well as raising or lowering the rear portion of the running deck.

The connection between the central axle and the base can further include a bearing surface that further promotes the smooth transition from one lateral tilt angle to another lateral tilt angle. This bearing surface may include a smooth metal or ceramic surface. In other examples, the connection between the central axle and the base is lubricated to further promote the smooth transition. Another benefit to the principles described in the present disclosure include that the mechanisms for changing the lateral tilt angle is robust without delicate parts. As a result, little or no maintenance for the components dedicated to changing the lateral tilt of the running deck may be necessary.

The treadmill may include a running deck that can support the weight of a user and that is attached to a frame. The running deck incorporates a tread belt that extends from a first pulley at a first location to a second pulley at a second location. The underside of the tread belt's mid-section is supported by a low friction surface that allows the tread belt's underside to move along the mid-section's length without creating significant drag. The tread belt is moved by a motor that is connected to the first pulley and is disposed within a housing in a front portion of the running deck. As the tread belt moves, a user positioned on the tread belt can walk or run in place by keeping up with the tread belt's speed.

A control console may be supported by the frame. For example, a first frame post may position a first hand hold near the control console, and a second frame post positions a second hand hold near the control console so that a user can support himself or herself during exercise. The control console allows the user to perform a predetermined task while simultaneously operating an exercise mechanism of the treadmill such as control parameters of the running deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the control console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulate route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

As the user begins to walk or run on the running deck, the display may change the scenery to mimic what the user would see if the user were actually at the real world location of the selected route. For example, a tree or another object located along the route that appears to be in the distance when the user is simulated to be at the beginning of the route may appear progressively closer as the user walks or runs on the running deck based on the speed at which the user is simulated to be traveling. Additionally, as the inclines and slopes of the simulated route change as the user progresses along the simulated route, the running deck can adjust to account for these terrain changes. For example, if the steepness of an uphill incline increases in the route, the running deck can likewise increase the incline of the running deck to mimic the change in steepness. Further, if the lateral angle of the route changes, the running deck can tilt laterally to one side to mimic the route's lateral angle.

The running deck may be laterally tilted with any appropriate tilting mechanism. In the illustrated figures, the running deck is supported on a chassis that is pivotally connected to a base along a central axle of the chassis. A first linear actuator is connected to a first side of the chassis, and a second linear actuator is connected to a second side of the chassis. As the first linear actuator extends, the first side of the running deck rises causing the lateral tilt angle to change. Likewise, as the second linear actuator extends, the second side of the running deck rises causing the lateral tilt angle to change. Retracting either the first or second linear actuators also causes the lateral tilt angle to change. In some examples, either the first or the second linear actuator extends while other linear actuator simultaneously retracts to create the desired lateral tilt angle. In other examples, the linear actuators are controlled to adjust the elevation of just one side of the running deck at a time.

Any appropriate type of linear actuator may be used in accordance with the principles described herein. For example, a non-exhaustive list of linear actuators that may be used as the first or second linear actuator includes screw actuators, hydraulic actuators, pneumatic actuators, solenoids, magnetic actuators, cams, electro-mechanical actuators, telescoping actuators, other types of linear actuators, or combinations thereof. Further, the linear actuators may be powered with a motor, compressed gas, electricity, magnetic fields, other types power sources, or combinations thereof. Further, the linear actuators may also have the ability to laterally tilt the running deck to any appropriate angle formed between a running surface of the running deck and the surface upon which the treadmill rests. For example, the range of the lateral tilt angle may span from negative 55 degrees to positive 55 degrees measured from either the first side or the second side or any range there between.

In some examples, a chassis end of the linear actuators is connected to the chassis, and a base end of the linear actuators is connected to the base. Each actuator connection may include a pivot so that the orientation of the linear actuators may move as the running deck changes orientations. But, any appropriate type of actuator connection to the base and/or the running deck, may be used in accordance with the principles described herein. Any appropriate number of linear actuators on each side may be used to cause the running deck to tilt. For example, multiple linear actuators may be evenly distributed along the length of either or both of the first side and second side to support the weight of the running deck. In others examples, an additional linear actuator is positioned at a location along the length of either or both of the first and second side to correspond where the user's weight is likely to be loaded to the running deck. In some examples, the linear actuators may be attached to tracks of the chassis and of the base so that the linear actuators can slide along the lengths of the first and/or second sides to appropriate position the linear actuators at those locations along the first and second sides based on where the user's weight is actually being loaded to the running deck. Further, the treadmill may incorporate at least one stand upon which the running deck can rest. In this example, the linear actuators can lift the appropriate side of the running deck to the appropriate height, and the stands can help hold the weight of the running deck in place while the lateral tilt angle is being maintained.

The chassis may include any appropriate type of structure shape. For example, the chassis may form a rectangular perimeter on which the running deck can be secured. In some examples, a central axle may bifurcate or otherwise divide the rectangular perimeter. In this example, the central axle may be pivotally connected to the base so that when either the first or the second linear actuator changes their height to change the lateral tilt angle of the running deck that the chassis, and therefore the running deck, pivot about the central axle. In other examples, the chassis has a front beam and a rear beam that are pivotally attached to the base. The structure of the chassis may also include a solid structure, multiple trusses, other types of supports, other types of structures, or combinations thereof.

In some cases, the chassis is inclined by raising or lowering the front portion of the central axle. In these situations, the central axle is still free to rotate. Thus, the chassis can be moved to cause the deck to change the front elevation of the deck and tilt angle simultaneously. Likewise, the elevation of the deck's rear portion can also be changed by changing the elevation of the rear portion of the central axle. With the rear portion of the central axle lowered, the central axle is still free to rotate. Thus, the deck's rear portion can have a change in its incline angle and tilt angle at the same time.

In some examples, the base is part of the treadmill's frame and is integrally connected to the frame posts that support the control console. But, in other examples, the base may be independent of the treadmill's frame.

The running deck may also have the capability of adjusting the height of both its front portion and rear portion. For example, a motor may be positioned in the front portion of the running deck that can adjust the height of the front portion to cause the running deck to be sloped at an incline. Further, another motor may be positioned at the rear portion to adjust the height of the rear portion to cause the running deck to be sloped at a decline. While this example has been described with reference to independent mechanisms for independently lowering and raising the front portion and the rear portion, these height adjustments may be executed with a single mechanism. For example, a height adjustment mechanism positioned in the front portion of the running deck may include a height adjustment range sufficient to lower the front portion so that the running deck is brought into a declining orientation. Continuing with the same example, the same height adjustment mechanism may also raise the front portion high enough to orient the running deck in an incline.

Regardless of the type of inclining and/or declining mechanisms incorporated into treadmill, these height adjustment mechanisms may incline or decline the running deck at any appropriate slope. For example, the range of the running deck's lengthwise slope may range from negative 60 degree to positive 60 degrees or any range there between.

While the above described examples have been described with reference to a treadmill with a running deck that can change its lengthwise slope and lateral tilt angle in response to instructions from a workout program simulating a route, the lengthwise slope and lateral tilt angle may be adjusted in response to any appropriate source of instructions. For example, the control console may include input mechanisms for the user to instruct the treadmill to change the lengthwise slope or the lateral tilt angle at the user's request independent of a simulation program.

What is claimed is:

1. A treadmill, comprising:

a running deck, the running deck comprising:

a front portion;

a rear portion connected to the front portion by a first side and a second side;

a tread belt surrounding the front portion and the rear portion;

a motor to drive movement of the tread belt;

a chassis that supports the running deck, the chassis including a front beam, a rear beam, and a central axle connecting the front beam to the rear beam along a length of the running deck;

a base that supports the chassis;

at least one actuator that causes the running deck to tilt laterally by rotating the chassis about the central axle towards either the first side or the second side to form a lateral tilt angle in response to a tilt command;

wherein the actuator is connected to both the chassis and the base.

2. The treadmill of claim 1, wherein the actuator is positioned to adjust a first elevation of the first side of the running deck.

3. The treadmill of claim 2, wherein the actuator is positioned to adjust a second elevation of the second side of the running deck.

4. The treadmill of claim 1, wherein a height adjustment mechanism elevates the front portion to position the running deck at a positive lengthwise slope in response to a slope command.

5. The treadmill of claim 1, wherein a height adjustment mechanism elevates the rear portion to position the running deck at a negative lengthwise slope in response to a slope command.

6. The treadmill of claim 1, wherein the actuator creates the lateral tilt angle while the motor drives the tread belt in response to the tilt command.

7. The treadmill of claim 1, further comprising a processor and a memory, wherein the memory includes programmed instructions executable by the processor to:

elevate the first side or the second side to create the lateral tilt angle by sending the tilt command.

8. The treadmill of claim 7, comprising further instructions executable by the processor to simulate a real world route on the treadmill.

9. The treadmill of claim 8, comprising further instructions executable by the processor to create the lateral tilt angle while simulating the real world route.

10. The treadmill of claim 7, comprising further instructions executable by the processor to create the lateral tilt angle while elevating the front portion of the running deck.

11. The treadmill of claim 7, comprising further instructions executable by the processor to create the lateral tilt angle while elevating the rear portion of the running deck.

12. A treadmill, comprising:

a running deck, the running deck comprising:

a front portion;

a rear portion connected to the front portion by a first side and a second side;

a tread belt surrounding the front portion and the rear portion;

a motor to drive movement of the tread belt;

an actuator that causes the running deck to tilt laterally towards either the first side or the second side to form a lateral tilt angle in response to a tilt command;

a chassis that supports the running deck;

the chassis including a front beam, a rear beam, and a central axle connecting the front beam to the rear beam; and a base that support the chassis;

wherein the actuator is connected to both the chassis and the base;

wherein the actuator causes the running deck to pivot about the central axle to create the lateral tilt angle.

13. The treadmill of claim 12, wherein the actuator creates the lateral tilt angle while the motor drives the tread belt.

14. The treadmill of claim 12, further comprising a processor and a memory, wherein the memory includes instructions executable by the processor to:

elevate the first side or the second side to create the lateral tilt angle.

15. The treadmill of claim 14, comprising further instructions executable by the processor to simulate a real world route on the treadmill.

16. The treadmill of claim 14, comprising further instructions executable by the processor to create the lateral tilt angle while changing an elevation of the front portion of the running deck.

17. The treadmill of claim 14, comprising further instructions executable by the processor to create the lateral tilt angle or while changing an elevation of the rear portion of the running deck.

18. A treadmill, comprising:

a running deck, the running deck comprising:

a front portion;

a rear portion connected to the front portion by a first side and a second side;

a tread belt surrounding the front portion and the rear portion;

a motor to drive movement of the tread belt;

an actuator that causes the running deck to tilt laterally towards either the first side or the second side to form a lateral tilt angle in response to a tilt command;

a chassis that supports the running deck;

the chassis including a front beam, a rear beam, and a central axle connecting the front beam to the rear beam;

a base that supports the chassis;

wherein the actuator is connected to both the chassis and the base;

wherein the actuator causes the running deck to pivot to create the lateral tilt angle by rotating the chassis about the central axle; and a processor and a memory, wherein the memory includes instructions executable by the processor to:

elevate the first side or the second side to create the lateral tilt angle;

simulate a real world route on the treadmill; and create the lateral tilt angle while elevating the front portion of the running deck or while elevating the rear portion of the running deck.

* * * * *